US011131077B2

(12) United States Patent
Nanjo

(10) Patent No.: US 11,131,077 B2
(45) Date of Patent: Sep. 28, 2021

(54) HYDRAULIC SYSTEM

(71) Applicant: KOBELCO CONSTRUCTION MACHINERY CO., LTD., Hiroshima (JP)

(72) Inventor: Takao Nanjo, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 16/650,558

(22) PCT Filed: Jun. 12, 2018

(86) PCT No.: PCT/JP2018/022342

§ 371 (c)(1),
(2) Date: Mar. 25, 2020

(87) PCT Pub. No.: WO2019/064715

PCT Pub. Date: Apr. 4, 2019

(65) Prior Publication Data

US 2020/0291613 A1 Sep. 17, 2020

(30) Foreign Application Priority Data

Sep. 29, 2017 (JP) ..... JP2017-191617

(51) Int. Cl.
*E02F 9/12* (2006.01)
*E02F 9/22* (2006.01)
*F15B 11/028* (2006.01)

(52) U.S. Cl.
CPC ..... *E02F 9/123* (2013.01); *E02F 9/2242* (2013.01); *E02F 9/2296* (2013.01);
(Continued)

(58) Field of Classification Search
CPC ..... E02F 9/123
See application file for complete search history.

(56) References Cited

U.S. PATENT DOCUMENTS 7,530,225 B2 * 5/2009 Ikeda ..... E02F 3/43 60/421
7,743,611 B2 * 6/2010 Horii ..... E02F 9/2296 60/421

(Continued)

FOREIGN PATENT DOCUMENTS

JP 7-71410 A 3/1995
JP 2007-100317 A 4/2007

(Continued)

OTHER PUBLICATIONS

International Search Report dated Aug. 7, 2018 in PCT/JP2018/022342 filed Jun. 12, 2018, 1 page.

(Continued)

*Primary Examiner* — Thomas E Lazo
*Assistant Examiner* — Michael Quandt
(74) *Attorney, Agent, or Firm* — Oblon, McClelland, Maier & Neustadt, L.L.P.

(57) ABSTRACT

A hydraulic system is capable of improving the acceleration performance of a slewing motor and suppressing an increase in the flow rate of hydraulic fluid supplied to the slewing motor. The hydraulic system includes a slewing speed sensor that detects a slewing speed of a slewing body and a controller that controls a slewing motor capacity, which is a capacity of the slewing motor. The controller controls the slewing motor capacity so as to make the slewing motor capacity when the slewing speed is in a low speed range be greater than the slewing motor capacity when the slewing speed is in a high speed range.

2 Claims, 7 Drawing Sheets

(52) U.S. Cl.
CPC ... *F15B 11/028* (2013.01); *F15B 2211/20576* (2013.01); *F15B 2211/6306* (2013.01); *F15B 2211/6336* (2013.01); *F15B 2211/7053* (2013.01); *F15B 2211/7058* (2013.01); *F15B 2211/75* (2013.01)

(56) References Cited

U.S. PATENT DOCUMENTS

| | | | | |
|---|---|---|---|---|
| 2014/0060018 | A1* | 3/2014 | Ma | F15B 21/14 60/327 |
| 2015/0075147 | A1 | 3/2015 | Shang et al. | |

FOREIGN PATENT DOCUMENTS

| | | | |
|---|---|---|---|
| JP | 2008-82127 | A | 4/2008 |
| JP | 2011-38298 | A | 2/2011 |
| JP | 2011-179280 | A | 9/2011 |
| WO | WO 2016/121185 | A1 | 8/2016 |

OTHER PUBLICATIONS

Extended European Search Report dated Sep. 15, 2020 in European Patent Application No. 18862562.8, 6 pages. Ax Ay.
Notice of Reasons for Refusal dated Feb. 24, 2021 in corresponding Japanese Patent Application No. 2017-191617 (with English translation)(6 pages).

* cited by examiner

HYDRAULIC SYSTEM

TECHNICAL FIELD

The present invention relates to a hydraulic system for driving a slewing body of a construction machine.

BACKGROUND ART

A conventional hydraulic system for driving a slewing body of a construction machine includes a slewing motor that stews the slewing body and a hydraulic pump that supplies hydraulic fluid to the slewing motor, for example, as shown in FIG. 5 of Patent Literature 1. In addition, Patent Literature 1 discloses in FIGS. 5 and 6 a technique of increasing the capacity of the slewing motor with increase in the bottom pressure of a boom cylinder.

However, reduction in the capacity of the stewing motor involved by the decrease in the bottom pressure of the boom cylinder may degrade the acceleration performance of the slewing motor. On contrary, increase in the capacity of the slewing motor involved by the increase in the bottom pressure of the boom cylinder may increase the flow rate of hydraulic fluid supplied to the slewing motor.

CITATION LIST

Patent Literature

Patent Literature 1: Japanese Unexamined Patent Publication No. 2011-38298

SUMMARY OF INVENTION

It is an object of the present invention to provide a hydraulic system capable of both improving the acceleration performance of a slewing motor and suppressing an increase in the flow rate of hydraulic fluid supplied to the slewing motor.

Provided is a hydraulic system installed on a construction machine including a slewing body, comprising: a hydraulic pump that discharges hydraulic fluid; a slewing motor formed of a variable displacement hydraulic motor operated by hydraulic fluid supplied from the hydraulic pump to slew the slewing body; a slewing speed sensor that detects a slewing speed of the slewing body; and a controller that controls a capacity of the slewing motor. In the controller, speed ranges with respect to the slewing speed are set, the speed ranges including a low speed range in which any slewing speed is less than or equal to a certain value and a high speed range in which any slewing speed is higher than that in the low speed range. The controller is configured to perform a large-capacity-in-low-speed-range control of controlling the slewing motor capacity so as to make the slewing motor capacity when the slewing speed detected by the slewing speed sensor is in the low-speed range be greater than the slewing motor capacity when the slewing speed is in the high speed range.

DESCRIPTION OF EMBODIMENTS

Figure 1:
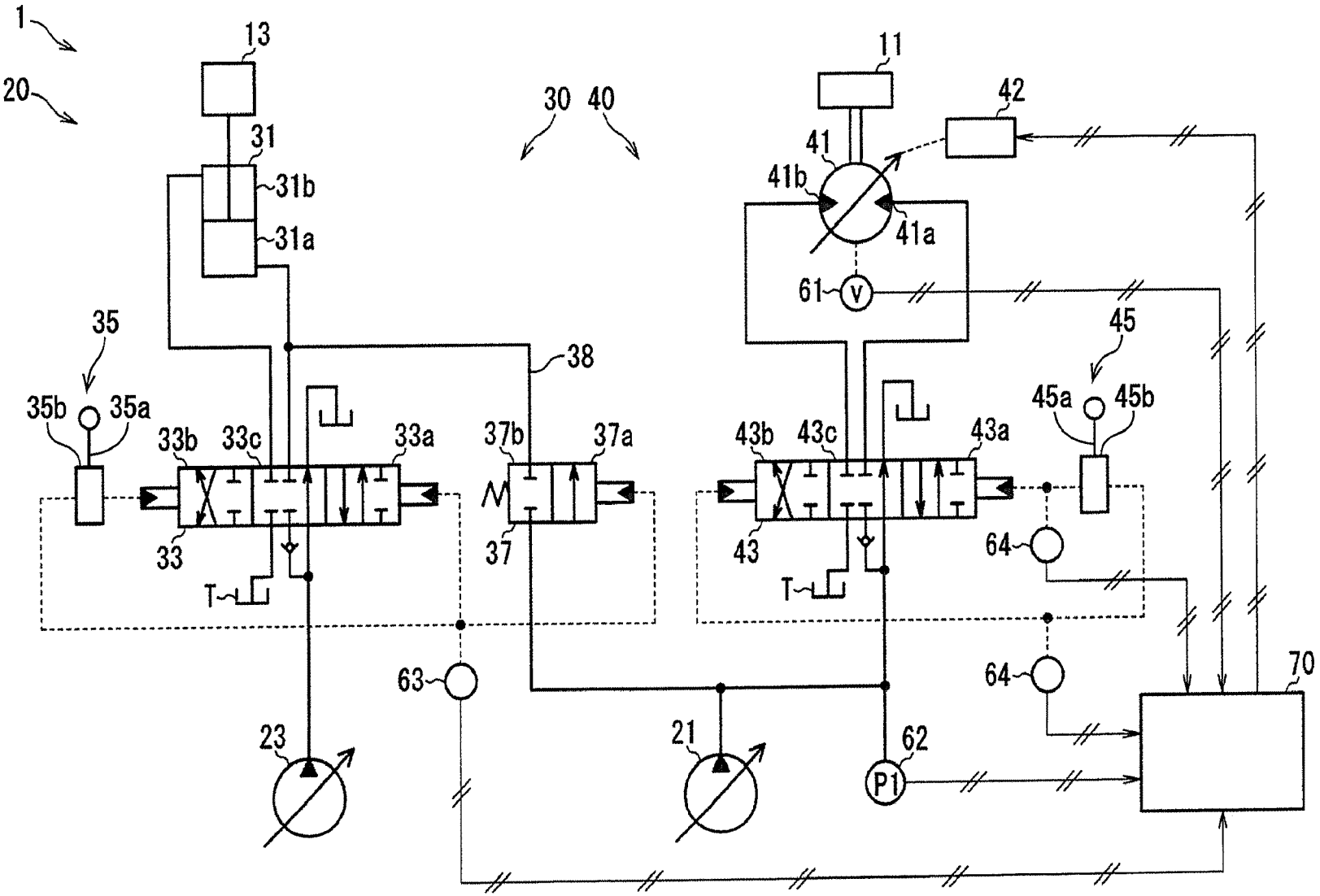
FIG. 1 is a circuit diagram of a hydraulic system according to an embodiment of the present invention.

A preferred embodiment of the present invention will be described with reference to FIGS. 1 to 7. FIG. 1 shows a hydraulic system 20 according to the embodiment.

The hydraulic system 20 is installed on a construction machine 1. The construction machine 1 is a machine for performing construction work, for example, an excavator. The construction machine 1 includes a not-graphically-shown lower travelling body, a slewing body (upper slewing body) 11 that is an inertial body, a boom 13, and the hydraulic system 20.

The slewing body 11 is mounted on the lower travelling body so as to be able to be slewed relatively to the lower travelling body. The lower travelling body is a part that travels on the ground.

The boom 13 is supported on the slewing body 11 so as to be rotationally movable up and down about a horizontal axis, that is, so as to be able to be raised and lowered. The boom 13 has a distal end to which, for example, a not-graphically-shown arm is rotatably attached. The arm has a distal end to which, for example, a not-graphically-shown bucket is rotatably attached.

The hydraulic system 20 hydraulically slews the slewing body 11 and controls the slewing thereof. The hydraulic system 20 includes a main pump 21, a boom cylinder pump 23, a boom control section 30, a slewing motor control section 40, a plurality of sensors, and a controller 70.

The main pump 21 corresponds to a hydraulic pump according to the present invention, configured to be driven to discharge hydraulic fluid. The boom cylinder pump 23 is a hydraulic pump that is provided independently of the main pump 21 and configured to be driven to discharge hydraulic fluid.

The boom control section 30 causes the boom 13 to make up-and-down movement and controls the movement. The boom control section 30 includes a boom cylinder 31, a boom control valve 33, a boom operation device 35, and a merging valve 37.

The boom cylinder 31 is an actuator for actuating the boom 13, being formed of a hydraulic cylinder capable of being expanded and contracted. The expansion and contraction of the boom cylinder 31 moves the boom 13 up and down relatively to the slewing body 11. The boom cylinder 31 is expanded and contracted by hydraulic fluid supplied from the boom cylinder pump 23. The boom cylinder 31 can receive supply of hydraulic fluid from both the pump 21 and the boom cylinder pump 23 as described later. The boom cylinder 31 has a head chamber 31*a* and a rod chamber 31*b*. The boom cylinder 31 is expanded through supply of hydraulic fluid to the head chamber 31*a*, thereby raising the boom 13 and discharging hydraulic fluid from the rod chamber 31*b*. On the other hand, the boom cylinder 31 is contracted through supply of hydraulic fluid to the rod chamber 31*b*, thereby lowering the boom 13 and discharging hydraulic fluid from the head chamber 31*a*.

The boom control valve 33 is a valve for controlling the flow direction and the flow rate of the hydraulic fluid supplied from the boom cylinder pump 23 to the boom cylinder 31. The boom control valve 33 is disposed between the boom cylinder pump 23 and the boom cylinder 31 in the hydraulic circuit. The boom control valve 33 has a plurality of selectable positions. The selectable positions of the boom control valve 33 are selected through a boom command (for example, a hydraulic pilot pressure) input to the boom control valve 33. The plurality of selectable positions include a first operation position 33*a*, a second operation position 33*b*, and a neutral position 33*c*.

The first operation position 33*a* is a boom raising position, at which the boom control valve 33 forms a fluid passage that allows hydraulic fluid to be supplied from the boom cylinder pump 23 to the head chamber 31*a* and allows hydraulic fluid to be returned from the rod chamber 31*b* to a tank T. The boom 13 is thereby moved up, that is, raised. The second operation position 33*b* is a boom lowering position, at which the boom control valve 33 forms a fluid passage that allows hydraulic fluid to be supplied from the boom cylinder pump 23 to the rod chamber 31*b* and allows hydraulic fluid to be returned from the head chamber 31*a* to the tank T. The boom 13 is thereby lowered. At the neutral position 33*c*, the boom control valve 33 blocks hydraulic fluid from being supplied from the boom cylinder pump 23 to the boom cylinder 31.

The boom operation device 35 receives a boom operation applied by an operator who operates the construction machine 1. The boom operation is an operation to activate the boom cylinder 31 to raise and lower the boom 13. The boom operation device 35 according to the present embodiment is a boom remote control valve including a boom operation lever 35*a* as a boom operation member and a valve body 35*b*. The valve body 35*b* of the boom operation device 35 inputs a command (for example, a hydraulic pilot pressure) corresponding to the boom operation applied to the boom operation lever 35*a* to thereby change the selectable position of the boom control valve 33.

The merging valve 37 is a valve selectable between a position to allow hydraulic fluid to be supplied from the main pump 21 to the boom cylinder 31 and a position to block the supply. The merging valve 37 is disposed between the main pump 21 and the head chamber 31*a* of the boom cylinder 31. Specifically, the merging valve 37 is disposed in a merging fluid passage 38, which connects the main pump 21 to the fluid passage that interconnects the boom control valve 33 and the head chamber 31*a*. The merging valve 37 has a plurality of selectable positions, which include a communication position 37*a* and a block position 37*b*. At the communication position 37*a*, the boom-cylinder merging valve 37 opens the merging passage 38 to allow hydraulic fluid to be supplied from the main pump 21 to the head chamber 31*a*. At the block position 37*b*, the merging valve 37 blocks the merging passage 38, to thereby block hydraulic fluid from being supplied from the main pump 21 to the head chamber 31*a*. The selectable position of the merging valve 37 is changed in accordance with a merging command that is input to the merging valve 37. The merging command is, for example, a hydraulic pilot pressure, which is, in the present embodiment, a boom raising command (a boom raising pilot pressure) for raising the boom 13, being one of the above-mentioned boom driving commands.

The slewing control section 40 causes the upper slewing body 11 to make slewing motion and controls the slewing motion thereof. The slewing control section 40 includes a slewing motor 41, a regulator 42, a slewing control valve 43, and a slewing operation section 45.

The slewing motor 41 is a variable displacement hydraulic motor. The slewing motor 41 slews the slewing body 11 relatively to the lower travelling body (that is not graphically shown). The slewing motor 41 slews the slewing body 11 through a reduction gear (not graphically shown). The slewing motor 41 receives supply of hydraulic fluid from the main pump 21 to be thereby operated to slew the slewing body 11. Hereinafter, the capacity of the slewing motor 41 will be referred to as "slewing motor capacity Cm". The slewing motor 41 includes a first port 41*a* and a second port 41*b*. Upon supply of hydraulic fluid to the first port 41*a*, the slewing motor 41 is rotated clockwise to slew the slewing body 11 clockwise and to discharge hydraulic fluid through the second port 41*b*. On the other hand, upon supply of hydraulic fluid to the second port 41*b*, the slewing motor 41 is rotated counterclockwise to slew the slewing body 11 counterclockwise and to discharge hydraulic fluid through the first port 41*a*.

The regulator 42 is connected to the slewing motor 41 to control the slewing motor capacity Cm. The regulator 42 is operated to adjust the slewing motor capacity Cm to a value corresponding to a capacity command signal that is input from the controller 70.

The slewing control valve 43 is a valve to control the flow direction and the flow rate of the hydraulic fluid supplied from the main pump 21 to the slewing motor 41. The slewing control valve 43 is disposed between the main pump 21 and the slewing motor 41. The slewing control valve 43 has a plurality of selectable positions. The selectable position of the slewing control valve 43 is changed through a slewing command (for example, a hydraulic pilot pressure) that is input to the slewing control valve 43. The plurality of selectable positions include a first operation position 43*a* as a clockwise slewing position, a second operation position 43*b* as a counterclockwise slewing position, and a neutral position 43*c*.

At each of the first operation position 43*a* and the second operation position 43*b*, the stewing control valve 43 forms a fluid passage that allows hydraulic fluid to be supplied from the main pump 21 to the slewing motor 41. Specifically, at the first operation position 43*a*, the slewing control valve 43 forms a fluid passage that allows hydraulic fluid to be supplied from the main pump 21 to the first port 41*a* of the slewing motor 41 and allows hydraulic fluid to be returned from the second port 41*b* to the tank T. The slewing motor 41 is thereby rotated clockwise to slew the slewing body 11 clockwise as seen from the operator. On the other hand, at the second operation position 43*b*, the slewing control valve 43 forms a fluid passage that allows hydraulic fluid to be supplied from the main pump 21 to the second port 41*b* and allows hydraulic fluid to be returned from the first port 41*a* to the tank T. The slewing motor 41 is thereby rotated counterclockwise to slew the slewing body 11 counterclockwise as seen from the operator. At the neutral position 43*c*, the slewing control valve 43 blocks the fluid passage that connects the main pump 21 to the slewing motor 41, to thereby hinder hydraulic fluid from being supplied to the slewing motor 41.

The slewing operation section 45 receives a slewing operation that is applied by the operator who operates the construction machine 1. The slewing operation is an operation to activate the slewing motor 41 to slew the slewing body 11. The slewing operation section 45 according to the present embodiment is a slewing remote control valve including a slewing operation lever 45*a* as an operation member and a valve body 45*b*. The valve body 45*b* of the slewing operation section 45 inputs a command (for example, a hydraulic pilot pressure) corresponding to the slewing operation applied to the slewing operation lever 45*a* to thereby change the selectable position of the slewing control valve 43.

The plurality of sensors include a slewing speed sensor 61, a pump pressure sensor 62, a boom operation sensor 63, and a slewing operation sensor 64.

The slewing speed sensor 61 detects a rotational speed (for example, an angular velocity) of the slewing body 11 relative to the not-graphically-shown lower travelling body, and generates a slewing speed detection signal, which is an electrical signal corresponding to the detected rotational speed. Hereinafter, the rotational speed of the slewing body 11 relative to the lower traveling body will be referred to as "slewing speed Vs". The slewing speed sensor 61 may be configured to detect the slewing speed Vs either directly or indirectly. The slewing speed sensor 61 shown in FIG. 1 directly detects a rotational speed Vm of the slewing motor 41, and determines the slewing speed Vs of the slewing body 11 based on the thus detected rotational speed Vm.

The pump pressure sensor 62 detects a discharge pressure of the main pump 21, which will be referred to as "pump pressure P1" that is a pressure of hydraulic fluid discharged by the main pump 21, and generates a pump pressure detection signal, which is an electrical signal corresponding to the detected pump pressure P1.

The boom operation sensor 63 detects the boom operation that is applied to the boom operation lever 35*a* to actuate the boom 13. Thus, the boom operation sensor 63 detects whether the boom operation is applied or not to the boom operation device 35. The boom operation sensor 63 according to the present embodiment detects a boom raising operation for raising the boom 13 performed in the boom operation. Specifically, the boom operation sensor 63 according to the present embodiment detects a boom raising pilot pressure, which is a hydraulic pilot pressure input to the boom control valve 33 from the boom operation device 35, and generates a boom operation detection signal, which is an electrical signal corresponding to the detected boom raising pilot pressure. The boom operation sensor 63, alternatively, may include a potentiometer for detecting the angle of the boom operation lever 35*a*, or the like.

The slewing operation sensor 64 detects the slewing operation applied to the slewing operation lever 45*a* to slew the slewing body 11. Thus, the slewing operation sensor 64 detects whether the slewing operation is applied or not to the slewing operation section 45. The slewing operation sensor 64 according to the present embodiment detects a slewing pilot pressure, which is a hydraulic pilot pressure input to the slewing control valve 43 from the slewing operation section 45, and generates a slewing operation detection signal, which is an electrical signal corresponding to the detected slewing pilot pressure. The slewing operation sensor 64, alternatively, may include a potentiometer for detecting the angle of the slewing operation lever 45*a*, or the like.

The controller 70 conducts receiving and outputting signals, operations including judgments and calculations, and storing information. The controller 70 inputs the capacity command signal to the regulator 42 to thereby control the slewing motor capacity Cm. To the controller 70 are input respective detection signals generated by the plurality of sensors. Instead of the above-mentioned boom raising pilot pressure, the controller 70 may input to the boom merging valve 37 a merging command for changing the selectable position. The controller 70 calculates respective flow rates of hydraulic fluid required to activate the boom cylinder 31 and the slewing motor 41, and controls the respective discharge flow rates of the main pump 21 and the boom cylinder pump 21 based on the calculated flow rates.

The operations of the hydraulic system 20 with respect to the slewing motion of the slewing body 11 are as follows. The slewing operation section 45 inputs to the slewing control valve 43 the slewing pilot pressure, which is the slewing command corresponding to the slewing operation applied to the slewing operation lever 45*a* by the operator. The slewing control valve 43 is shifted to the first operation position 43*a* or the second operation position 43*b* dependently on with the input slewing command. The hydraulic fluid discharged by the main pump 21 is thereby allowed to flow into the slewing motor 41 through the slewing control valve 43, rotating the motor 41 to slew the slewing body 11 relatively to the lower travelling body.

The operations of the hydraulic system 20 with respect to the up and down movement of the boom 13 are as follows. The boom operation device 35 inputs to the boom control valve 33 a boom pilot pressure, which is a hydraulic pilot pressure serving as the boom command corresponding to the boom operation applied to the boom operation lever 35*a* by the operator. The boom control valve 33 is shifted to the first operation position 33*a* or the second operation position 33*b* dependently on the input boom command. The hydraulic fluid discharged by the boom cylinder pump 23 is thereby allowed to flow into the boom cylinder 31 through the boom control valve 33, expanding or contracting the boom cylinder 31 to move the boom 13 up or down relatively to the slewing body 11.

For lowering the boom 13, no pilot pressure is input to the merging valve 37, thus keeping the merging valve 37 at the block position 37*b*. In contrast, for raising the boom 13, a boom raising pilot pressure is input to the merging valve 37 to shift the merging valve 37 to the communication position 37*a*, thus allowing hydraulic fluid to be supplied from both the boom cylinder pump 23 and the main pump 21 to the boom cylinder 31. This makes the flow rate of hydraulic fluid supplied to the boom cylinder 31 be greater than that in the case of no supply of hydraulic fluid from the main pump 21 to the boom cylinder 31, thus increasing the action (expansion) speed of the boom cylinder 31.

When simultaneous operational action is performed in which a slewing operation and a boom raising operation are simultaneously applied to the slewing operation lever 45*a* and the boom raising operation, respectively, the slewing body 11 is slewed and simultaneously the boom 13 is raised. At this time, the main pump 21 supplies hydraulic fluid to the boom cylinder 31 and the slewing motor 41 simultaneously and in parallel. In other words, hydraulic fluid is supplied through a parallel branch circuit. Therefore, during the simultaneous operational action, important is appropriate distribution of the flow rate of hydraulic fluid discharged by the main pump 21 to the boom cylinder 31 and the slewing motor 41.

Figure 2:
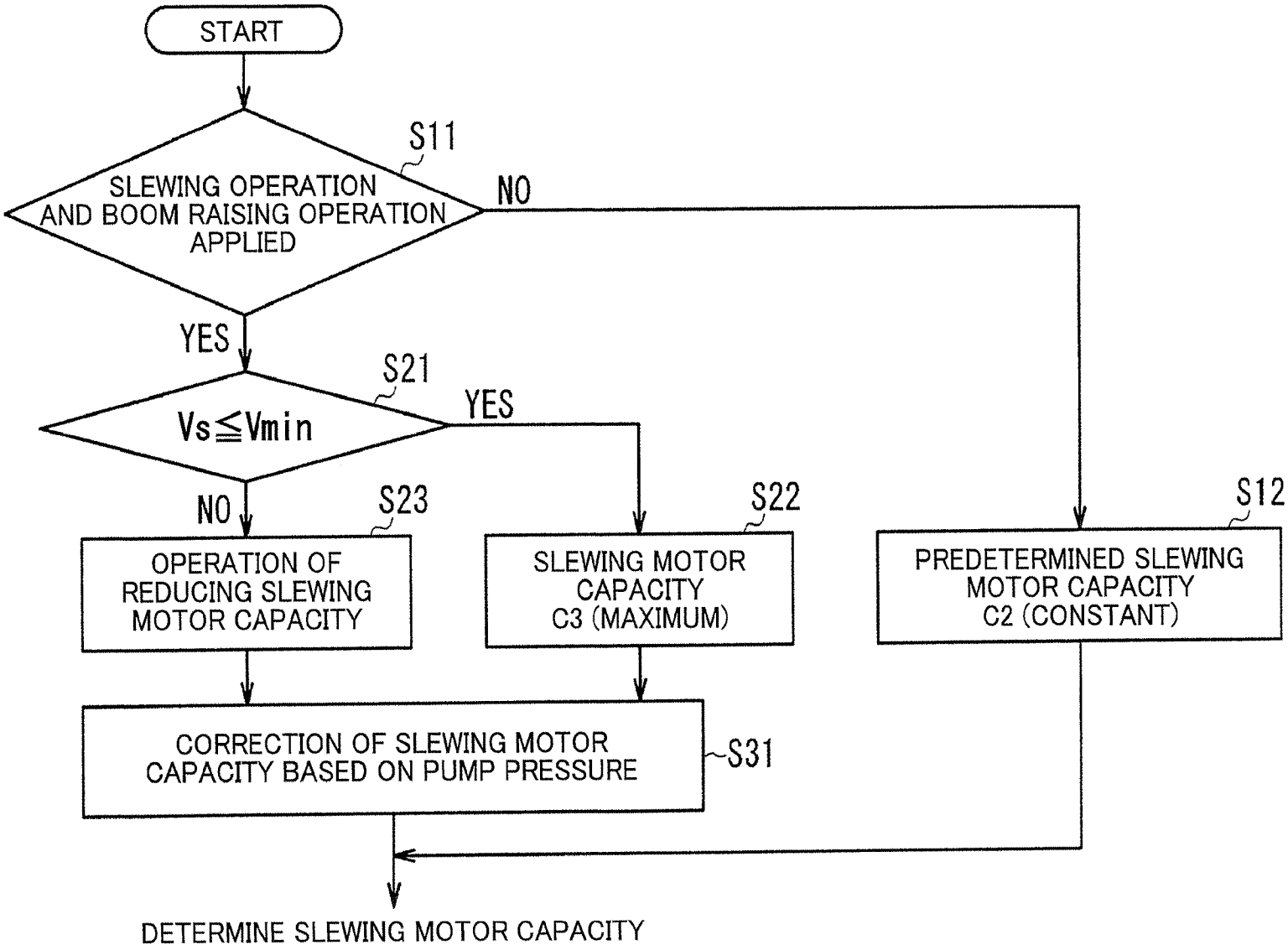
FIG. 2 is a flowchart showing calculation-and-control operations performed by a controller in the hydraulic system shown in FIG. 1.

FIG. 2 shows calculation-and-control actions that the controller 70 makes with respect to the control of the slewing motor capacity Cm. Hereinafter, description will be given with reference to FIG. 1 regarding each of the above-described components of the hydraulic system 20, and with reference to FIG. 2 regarding each step of the calculation-and-control operations.

Figure 3:
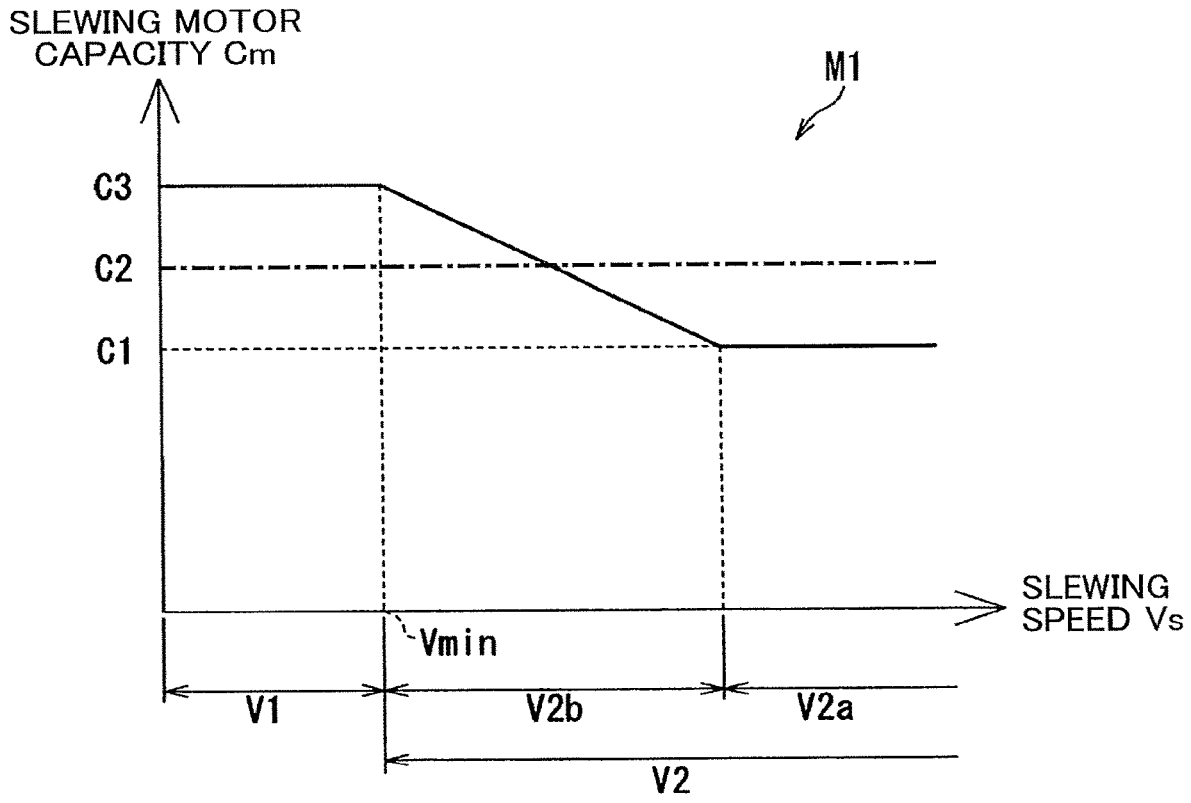
FIG. 3 is a graph showing a relationship between speed of a slewing body 11 shown in FIG. 1 and slewing motor capacity Cm.

The controller 70 performs large-capacity-in-low-speed-range control as shown in FIG. 3. The large-capacity-in-low-speed-range control is a control to make the slewing motor capacity Cm when the detected slewing speed Vs is in a low speed range V1 be greater than the slewing motor capacity Cm when the slewing speed Vs is in a high speed range V2. The low speed range V1 is a speed range preset in the controller 70 with respect to the slewing speed Vs, any slewing speed Vs in the low speed range V1 being less than or equal to a predetermined capacity-reduction minimum speed Vmin. The high speed range V2 is also one of the speed ranges set in advance in the controller 70 for the slewing speed Vs, any slewing speed Vs in the high speed range V2 being higher than the capacity-reduction minimum speed Vmin.

The large-capacity-in-low-speed-range control is performed when the slewing motor 41 and the boom cylinder 31 are operated simultaneously, i.e., when the simultaneous operational action is made. The large-capacity-in-low-speed-range control, however, may be performed also in a time other than a time when the simultaneous operational action is made.

Figure 4:
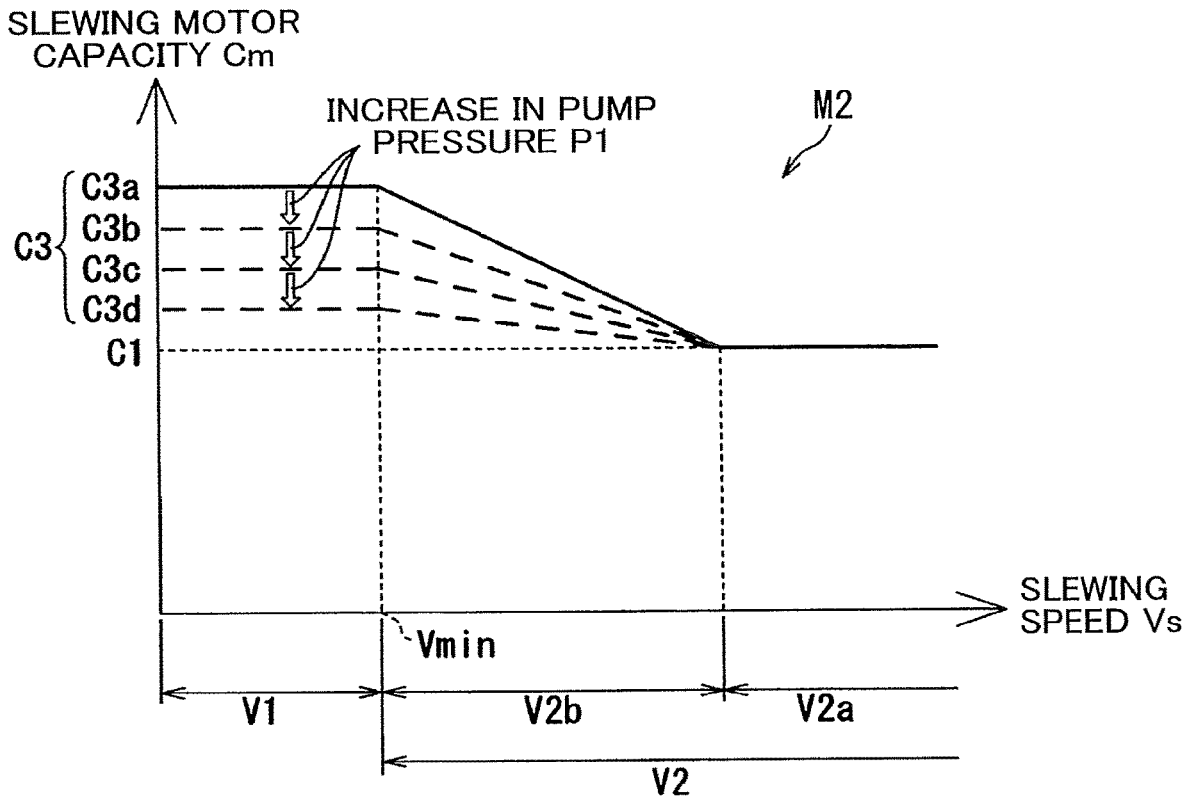
FIG. 4 is a graph showing a relationship between pump pressure of a pump 21 shown in FIG. 1 and the slewing motor capacity Cm.

The controller 70 also performs a small-capacity-for-high-pressure control shown in FIGS. 3 and 4. The small-capacity-for-high-pressure control is a control to reduce the slewing motor capacity Cm with increase in the pump pressure P1. The small-capacity-for-high-pressure control is performed when the slewing speed Vs is in the low speed range V1. The small-capacity-for-high-pressure control may be performed when the slewing speed Vs is either in the low speed range V1 or in a second high speed range V2*b* that is included in the high speed range V2. The high speed range V2 includes the second high speed range V2*b* and a first high speed range V2*a* that is a higher-speed range than the second high speed range V2*b*.

As shown in FIG. 2, the controller 70 first judges whether the slewing operation for slewing the slewing body 11 and the boom raising operation for raising the boom 13 are simultaneously applied to the operation levers 45*a* and 35*a*, respectively (i.e. whether the simultaneous operational action is performed) (step S11). Specifically, the controller 70 judges whether the slewing operation sensor 64 detects that the slewing operation is applied to the slewing operation section 45 and the boom operation sensor 63 detects that the boom raising operation is applied to the boom operation device 35.

If the simultaneous operational action is not performed (NO at step S11), the controller 70 determines the slewing motor capacity Cm to a predetermined capacity C2 (which is a regular capacity) shown in FIG. 3. The predetermined capacity C2 is, for example, constant irrespective of the slewing speed Vs. For example, when the slewing motion of the slewing body 11 (the rotation of the slewing motor 41) is braked, the slewing motor capacity Cm is set to the predetermined capacity C2.

When the simultaneous operational action is performed (YES at step S11), the controller 70 judges whether the slewing speed Vs is in the low speed range V1. Specifically, the controller 70 judges whether the slewing speed Vs detected by the slewing speed sensor 61 is less than or equal to the predetermined capacity-reduction minimum speed Vmin (step S21). If the slewing speed Vs is in the low speed range V1 (YES at step S21), the controller 70 sets the slewing motor capacity Cm to a specified capacity C3 (step S22). The capacity C3 is greater than the above-mentioned predetermined capacity C2. If the slewing speed Vs is not in the low speed range V1, i.e., if the slewing speed Vs is in the high speed range V2 (NO at step S21), the controller 70 sets the slewing motor capacity Cm to a value less than the capacity C3, i.e., a value reduced from the capacity C3 (step S23).

The controller 70 corrects the slewing motor capacity Cm determined at step S22 or step S23, based on the pump pressure P1 detected by the pump pressure sensor 62 (step S31). Specifically, the controller 70 corrects the slewing motor capacity Cm so as to reduce the slewing motor capacity Cm with increase in the pump pressure P1 (the small-capacity-for-high-pressure control). In other words, the controller 70 reduces the slewing motor capacity Cm set at step S22 or step S23 more as the pump pressure P1 increases, while performing no correction when the pump pressure P1 is less than or equal to a certain value.

For controlling the slewing motor capacity Cm based on the slewing speed Vs, the controller 70 may, for example, store in advance a mathematical relation for calculating the slewing motor capacity Cm using the slewing speed Vs. Alternatively, the controller 70 may store in advance control maps M1 to M3 such as those shown in FIGS. 3 to 5. Each of the control maps M1 to M3 specifies a relationship between the slewing speed Vs and the slewing motor capacity Cm. In each of the maps M1 to M3, a plurality of ranges (speed ranges) are set with respect to the slewing speed Vs, the plurality of speed ranges including the low speed range V1 and the high speed range V2.

The low speed range V1 is the lowest speed one of the plurality of speed ranges. The low speed range V1 may include a slewing speed Vs of zero (a stopped state of the slewing body 11). When the slewing speed Vs is in the low speed range V1, the controller 70 sets the slewing motor capacity Cm to the capacity C3. The capacity C3 may be either the greatest capacity of capacities that can be selected in the slewing motor 41 (that is, the motor's maximum capacity) or less than the motor's maximum capacity, which is, for example, a nearly maximum capacity. The capacity C3 is greater than the predetermined capacity C2. When the slewing speed Vs is in the low speed range V1, the slewing motor capacity Cm is set to the constant capacity C3 in the example shown in FIG. 3; however, the slewing motor capacity Cm at this time does not have to be constant. The capacity-reduction minimum speed Vmin shown in FIG. 3 is the lowest speed in the high speed range V2, i.e. the highest-speed in the low speed range V1.

The high speed range V2 is a range including higher slewing speeds Vs than that included in the low speed range V1 being a capacity reduction range that requires a reduction from the slewing motor capacity Cm. The controller 70 sets the slewing motor capacity Cm when the slewing speed Vs is in the high speed range V2 to a value less than the slewing motor capacity Cm (the capacity C3) when the slewing speed Vs is in the low speed range V1.

The high speed range V2 includes the first high speed range V2*a* and the second speed range V2*b*. The first high speed range V2*a* is the highest-speed range of the plurality of speed ranges. The first high speed range V2*a* may include a maximum slewing speed Vmax, which is the highest one of attainable slewing speeds Vs. When the slewing speed Vs is in the first high speed range V2*a*, the controller 70 sets the slewing motor capacity Cm to a capacity C1. The capacity C1 is less than the predetermined capacity C2. Alternatively, the capacity C1 may be equal to the predetermined capacity C2. The capacity C1 may be, for example, the smallest capacity of capacities that can be selected in the slewing motor 41. The slewing motor capacity Cm when the slewing speed Vs is in the first high speed range V2*a* does not have to be constant.

The second high speed range V2*b* is a speed range between the low speed range V1 and the first high speed range V2*a* (that is, an intermediate speed range). When the slewing speed Vs is in the second high speed range V2*b*, the controller 70 sets the slewing motor capacity Cm to a value more than or equal to the capacity C1 and less than the capacity C3. In the example shown in FIG. 3, the controller 70 continuously (or gradually) reduces the slewing motor capacity Cm with increase in the slewing speed Vs when the slewing speed Vs is in the second high speed range V2*b*. The slewing motor capacity Cm in the second high speed range V2*b* may be set so as to be reduced in a single stage or in a plurality of stages with increase in the slewing speed Vs. For example, the slewing motor capacity Cm may be switched between only two stages (for example, between the capacity C1 and the capacity C3) depending on whether the slewing speed Vs is in the low speed range V1 or in the high speed range V2. Besides, the high speed range V2 does not have to be divided into the first high speed range V2*a* and the second high speed range V2*b*.

Respective contents of the control maps M1 to M3, specifically, respective shapes of the graphs showing relationships between the slewing speed Vs and the slewing motor capacity Cm may be set in various ways. For example, although each of the graphs showing relationships between the slewing speed Vs in the second high speed range V2*b* and the slewing motor capacity Cm is a straight line graph in the examples shown in FIGS. 3 to 5, it may alternatively be a polygonal line graph, or a curve graph, or a stepped graph or a combination of these graphs.

As described above, the controller 70 changes the slewing motor capacity Cm based on the pump pressure P1 in the low speed range V1; however, changing the slewing motor capacity Cm based on the pump pressure P1 may be performed in the high speed range V2. Each of the control maps M2 and M3 shown in FIGS. 4 and 5 has the characteristic in which the slewing motor capacity Cm is changed according to the pump pressure P1 in the low speed range V1 and in the second high speed range V2*b*.

According to the control map M2 shown in FIG. 4, when the slewing speed Vs is in the low speed range V1, the slewing motor capacity Cm is set to a value reduced with increase in the pump pressure P1. For example, the slewing motor capacity Cm when the pump pressure P1 is less than or equal to a specified pressure is a capacity C3*a*. When the pump pressure P1 is higher than the specified pressure in the low speed range V1, the slewing motor capacity Cm is set to a value reduced with increase in the pump pressure P1 (see the capacity C3*b*, the capacity C3*c*, and the capacity C3*d*). The slewing motor capacity Cm when the slewing speed Vs is in the low speed range V1 may be set to a value that is reduced either in stages or continuously (steplessly) with increase in the pump pressure P1 increases (the same applies to the case of the second high speed range V2*b*).

The slewing motor capacity Cm when the slewing speed Vs is in the second high speed range V2*b* is set so as to be reduced with increase in the pump pressure P1. In the example shown in FIG. 4, the slope of the graph showing a relationship between the slewing speed Vs and the slewing motor capacity Cm become gentle (such that the absolute value of the inclination is reduced) with increase in the pump pressure P1 increases. Alternatively, as shown in the control map M3 of FIG. 5, another characteristic may be set in which the upper limit of the slewing motor capacity Cm in the second high speed range V2*b* is reduced with increase in the pump pressure P1. For example, the upper limit of the slewing motor capacity Cm in the second high speed range V2*b* may be either equal to the corresponding slewing motor capacity Cm in the low speed range V1 (see the capacities C3*a* to C3*d* in FIG. 5) or less than the corresponding slewing motor capacity Cm in the low speed range V1.

The reason for performing the small-capacity-for-high-pressure control is as follows. There is a possibility that the change in the pump pressure P1 changes the balance between respective behaviors of the boom cylinder 31 and the slewing motor 41. For example, the increase in the load on the boom 13 increases the holding pressure that is the pressure in the head chamber 31*a* of the boom cylinder 31 and also the pump pressure P1 substantially equal to the holding pressure. Besides, the increase in the load on the boom 13 tends to reduce the expansion speed of the boom cylinder 31. On the other hand, the increase in the pump pressure P1 increases the pressure of hydraulic fluid supplied to the slewing motor 41, the pressure corresponding to the slewing drive pressure, and the torque of the slewing motor 41, which tends to accelerate the slewing body 11. Thus, the increase in the pump pressure P1 tends to reduce the boom raising speed while tending to accelerate the slewing body 11. The change in the pump pressure P1, thus, tends to involve an increase in the speed of either one of the boom cylinder 31 and the slewing motor 41 and a reduction in the speed of the other (that is, to involve the change in the balance of their behaviors). This causes a possibility of extension of the time required for a work during the simultaneous operational action in which the slewing operation and the boom raising operation are simultaneously applied.

Since the torque of the slewing motor 41 is proportional to the product of the pressure of hydraulic fluid supplied to the motor 41 and the flow rate of the hydraulic fluid, the pressure being substantially equal to the pump pressure P1, the torque required to accelerate the slewing body 11 can be obtained even with reduction in the slewing motor capacity Cm, if the pump pressure P1 is high. Therefore, performing the small-capacity-for-high-pressure control, i.e. the control of reducing the slewing motor capacity Cm with increase in the pump pressure P1, makes it possible to restrict the flow rate of hydraulic fluid supplied to the slewing motor 41 while increasing the flow rate of hydraulic fluid supplied from the main pump 21 to the boom cylinder 31 to thereby increase the operation (expansion) speed of the boom cylinder 31. For example, through changing the slewing motor capacity Cm according to the pump pressure P1 so as to keep the torque of the slewing motor 41 constant (or so as to keep the torque within a specified range) regardless of the change in the pump pressure P1, the behavior balance can be maintained between the slewing motion of the slewing body 11 and the raising motion of the boom 13. This makes it possible to shorten the time required for a work during the simultaneous operational action in which the slewing operation and the boom raising operation are simultaneously applied.

Figure 6:
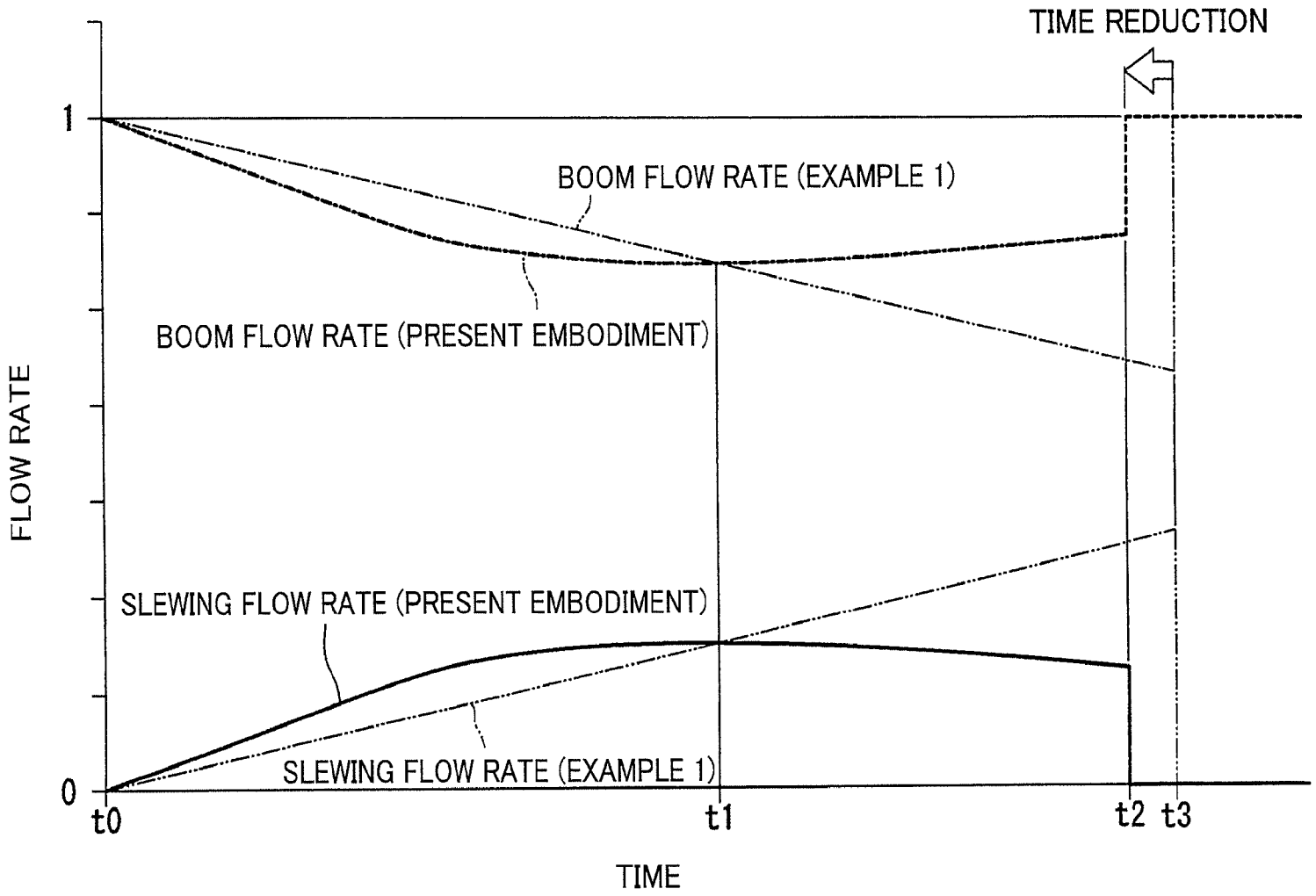
FIG. 6 is a graph showing temporal change in flow rate of hydraulic fluid in each of a slewing motor 41 and a boom cylinder 31 shown in FIG. 1.
Figure 7:
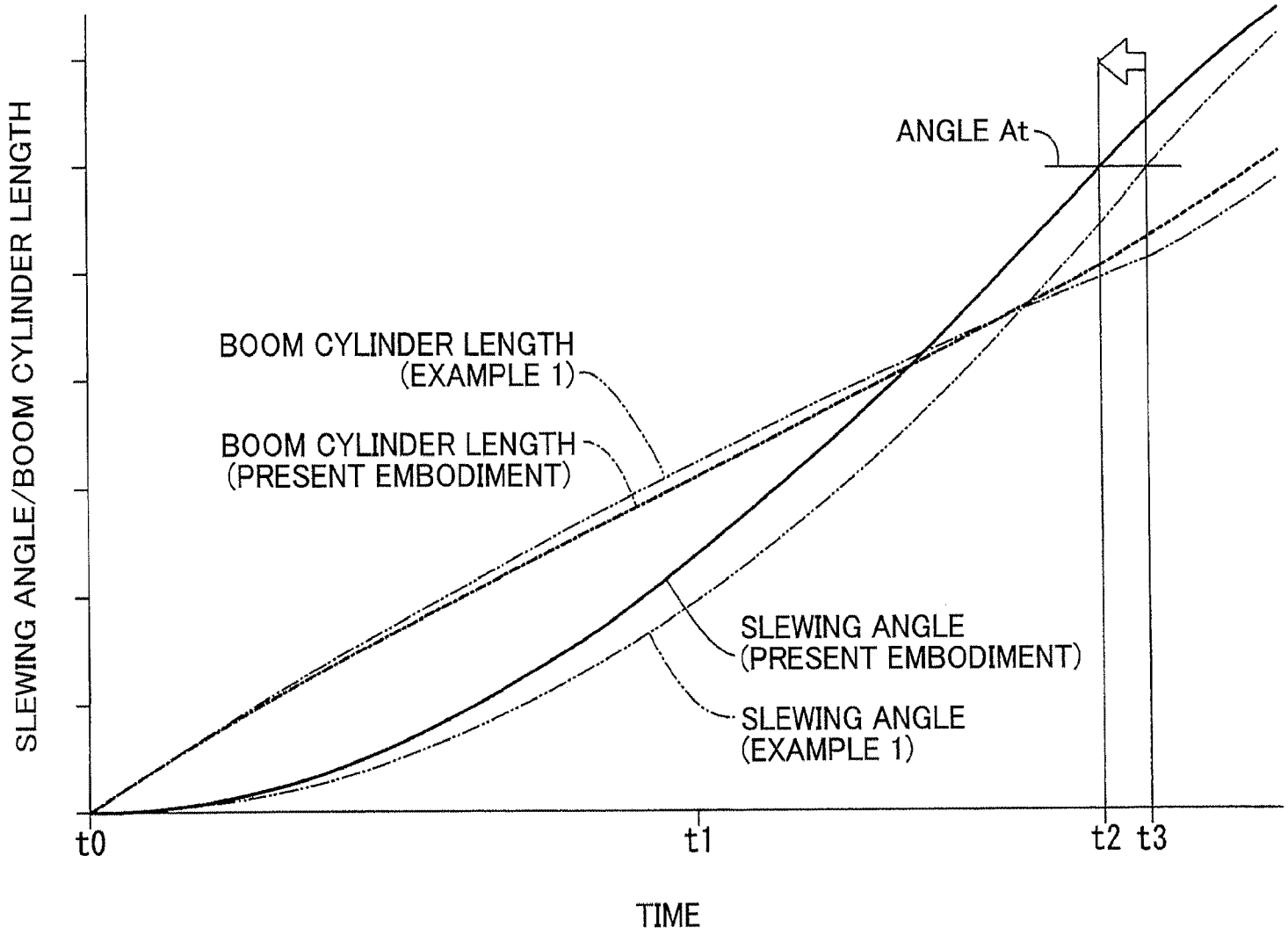
FIG. 7 is a graph showing temporal change in slewing angle of the slewing body 11 and length of the boom cylinder 31, the slewing body 11 and the boom cylinder 31 being shown in FIG. 1.

FIGS. 6 and 7 show respective behaviors of the boom cylinder 31, the slewing motor 41 and the like during the simultaneous operational action. FIGS. 6 and 7 each comparatively show the present embodiment and Example 1. In Example 1, the slewing motor capacity Cm is kept constant at the constant capacity C2 (see FIG. 3) irrespective of the slewing speed Vs during the simultaneous operational action. FIG. 6 is a graph showing the behaviors of (temporal changes in) the allocation between boom flow rate, which is the flow rate of hydraulic fluid supplied from the main pump 21 to the boom cylinder 31, and slewing flow rate, which is the flow rate of hydraulic fluid supplied from the main pump 21 to the slewing motor 41. FIG. 7 is a graph showing the behaviors of (temporal changes in) the slewing angle of the slewing body 11 and the length (stroke distance) of the boom cylinder 31. In FIG. 7, each of the slewing angle of the slewing body 11 and the length of the boom cylinder 31 is assumed to be zero at time t0. FIG. 6 shows relative magnitudes of the boom flow rate and the slewing flow rate to each other in each of the present embodiment and Example 1, and FIG. 7 shows relative magnitudes of the slewing angle and the length of the boom cylinder 31 to each other in each of the present embodiment and Example 1.

As shown in FIG. 6, at the beginning of acceleration of the slewing motor 41 (at the beginning of a slewing operation of the slewing body 11), the slewing flow rate in the present embodiment is greater than that in Example 1 (see time t0 to time W. Therefore, the torque of the slewing motor 41 in the present embodiment is greater than that in Example 1. This allows, as shown in FIG. 7, the slewing angle in the present embodiment to reach a specified (desired) angle At earlier than that in Example 1, thereby enabling the time required for the slewing operation to be shortened. Besides, as shown in FIG. 6, at the beginning of acceleration of the slewing body 11, the boom flow rate in the present embodiment is less than that in Example 1. Hence, as shown in FIG. 7, the boom cylinder 31 is shorter in the present embodiment than in Example 1 at the beginning of acceleration of the slewing body 11.

As shown in FIG. 6, the controller 70 performs the control of reducing the slewing motor capacity Cm with increase in the slewing speed Vs (see FIG. 3), thereby reducing the slewing flow rate. Moreover, the slewing rate in the present embodiment is less than that in Example 1 (see time t1 to time t2). On the other hand, the boom flow rate in the present embodiment is greater than in Example 1. Therefore, the expansion speed of the boom 13 in the present embodiment is higher than that in Example 1.

As shown in FIG. 7, the slewing body 11 in the present embodiment reaches the specified angle At earlier than that in Example 1. Therefore, the present embodiment allows the slewing operation to be completed at earlier timing (earlier time) than Example 1, thus allowing the supply of hydraulic fluid from the main pump 21 to the slewing motor 41 to be completed at an early timing (see time t2 to time t3). Hence, the hydraulic fluid discharged from the main pump 21 and allocated to the slewing motor 41 is allowed to be supplied to the boom cylinder 31, in terms of flow rate, at an earlier timing. This allows the boom cylinder 31 in the present embodiment to reach a specified (desired) length earlier than that in Example 1, thereby allowing the time required for a work during the simultaneous operational action to be shorten. For example, in the case of performing a work with the simultaneous operational action a plurality of times (repeatedly), the reduction in the time required for a single work with the simultaneous operational action (that is, cycle time) results in further reduction in the time required to perform the work at a plurality of times.

Although FIG. 7 shows the example where the slewing body 11 is rotated by inertia after the completion of the slewing operation at time t2 and FIG. 6 shows the example where the boom raising operation is continued after the completion of the slewing operation, the timing of the completion of the slewing operation and the timing of the completion of the boom raising operation vary depending on the content and conditions of the work. Hence, these timings may be the same, for example, approximately the same.

In the embodiment described above, the low speed range V1 and the high speed range V2 as shown in FIG. 3 are set in the controller 70, each being a speed range with respect to the slewing speed, and the controller 70 performs the large-capacity-in-low-speed-range control, i.e. the control of the slewing motor capacity Cm to make the slewing motor capacity Cm when the slewing speed Vs is in the low speed range V1 be greater than the slewing motor capacity Cm when the slewing speed Vs is in the high speed range V2. This large-capacity-in-low-speed-range control enables to be enhanced the acceleration performance of the slewing motor 41 shown in FIG. 1, for example, the acceleration performance of the slewing motor 41 when the slewing motor 41 is rotationally accelerated from the stopped state (at the beginning of a slewing operation).

Besides, the controller 70, making the slewing motor capacity Cm when the slewing speed Vs is in the high speed range V2 be smaller than the slewing motor capacity Cm when the slewing speed Vs is in the low speed range V1 as shown in FIG. 3, can suppress an increase in the slewing flow rate, i.e. the flow rate of hydraulic fluid supplied to the slewing motor 41 shown in FIG. 1.

Although the hydraulic system 20 according to the present embodiment, which further includes the boom cylinder 31 that is other than the slewing motor 41 and is a supply target hydraulic actuator operable by hydraulic fluid supplied from the main pump 21 in parallel to the slewing motor 41, has a possibility that the flow rate of hydraulic fluid supplied from the pump 21 to the boom cylinder 31 is so insufficient as to slow down the operation of the boom cylinder 31 when the hydraulic fluid discharged by the main pump 21 is supplied to both the slewing motor 41 and the boom cylinder 31, the controller 70 according to the present embodiment can suppress the reduction in the operation speed of the boom cylinder 31 through performing the large-capacity-in-low-speed-range control when the slewing motor 41 and the boom cylinder 31 are simultaneously activated. Specifically, the controller 70 can speed up the operation of the boom cylinder 31 through increasing the boom flow rate, namely, the flow rate of hydraulic fluid supplied from the main pump 21 shown in FIG. 1 to the boom cylinder 31, when the slewing speed Vs is in the high speed range V2.

The amount of operation (the amount of work or movement) of the boom cylinder 31 while the construction machine 1 is performing a work is usually greater than that of the other actuators (such as an arm actuator or a bucket actuator). Hence, in the case where the supply target hydraulic actuator that receives hydraulic fluid supplied from the main pump 21 simultaneously with the slewing motor 41 is the boom cylinder 31, the improvement of the workability of the construction machine 1 by the control of the controller 70 is more significant.

For example, the operation amount of the boom cylinder 31 is greater than that of an arm cylinder for rotating the arm relatively to the boom 13 and that of a bucket cylinder for rotating the bucket relatively to the arm. Hence, in the case where the supply target hydraulic actuator is the boom cylinder 31, the improvement of the workability of the construction machine 1 is more significant than that in the case where the supply target hydraulic actuator is the arm cylinder or the bucket cylinder.

The hydraulic system 20 according to the present embodiment further includes the pump pressure sensor 62 for detecting the pump pressure P1, which is the discharge pressure of the main pump 21, and the controller 70 performs the control of reducing the slewing motor capacity Cm with increase in the pressure P1, as shown in FIG. 4, to thereby speed up the operation of the boom cylinder 31 while ensuring the acceleration performance of the slewing motor 41. Specifically, since the torque of the slewing motor 41 is proportional to the product of the pump pressure P1 and the slewing motor capacity Cm shown in FIG. 3, it is not difficult to ensure the acceleration performance of the slewing motor 41 even with reducing the slewing motor capacity Cm with increase in the pump pressure P1. Hence, reducing the slewing flow rate, namely, the flow rate of hydraulic fluid supplied from the main pump 21 to the slewing motor 41 to increase the boom flow rate, namely, the flow rate of hydraulic fluid supplied from the main pump 21 to the boom cylinder 31, makes it possible to speed up the operation of the boom cylinder 31 while ensuring the acceleration performance of the slewing motor 41.

The present invention is not limited to the above-described embodiment, and the above-described embodiment may be modified in various ways.

Figure 5:
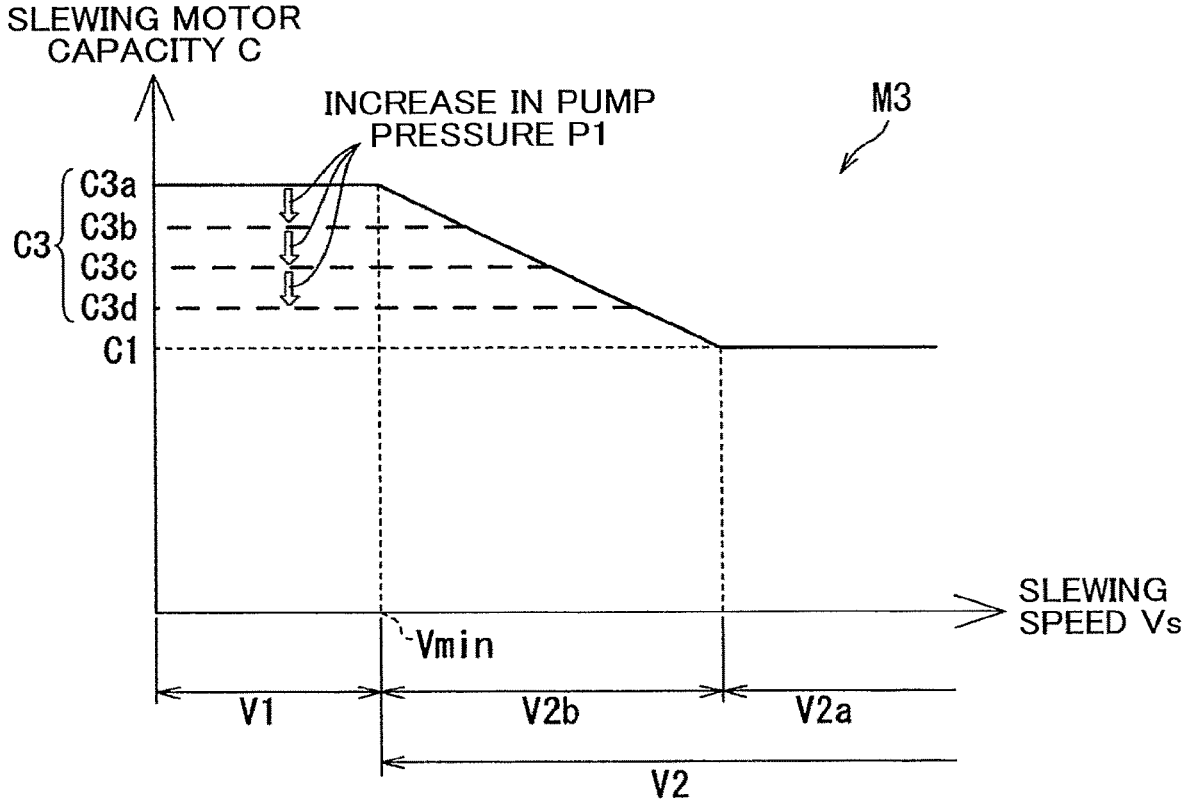
FIG. 5 is a graph showing a relationship between the pump pressure of the pump 21 shown in FIG. 1 and the slewing motor capacity Cm.

For example, it is possible to modify part or all of the following: the connections of the circuit shown in FIG. 1, the number of components of the construction machine 1, the order of steps of the flowchart shown in FIG. 2, the shapes of the control maps M1 to M3 (graphs) shown in FIGS. 3 to 5.

Each of the boom cylinder pump 23 and the merging valve 37 is not absolutely required. For example, hydraulic fluid is also allowed to be supplied to the boom cylinder 31 only from the main pump 21. Besides, the number of hydraulic pumps according to the present invention is not limited.

It may be omitted to correct the slewing motor capacity Cm based on the pump pressure P1 shown in FIG. 4.

"The supply target hydraulic actuator" that receives hydraulic fluid supplied from the common hydraulic pump simultaneously with the slewing motor is not limited to the boom cylinder 31 but also allowed to be, for example, an arm cylinder or a bucket cylinder. Alternatively, the supply target hydraulic actuator may be a hydraulic actuator other than a hydraulic cylinder, for example, a hydraulic motor.

As described above, according to the present invention, provided is a hydraulic system capable of both improving the acceleration performance of a slewing motor and suppressing an increase in the flow rate of hydraulic fluid supplied to the slewing motor. The hydraulic system comprises: a hydraulic pump that discharges hydraulic fluid; a slewing motor formed of a variable displacement hydraulic motor operated by hydraulic fluid supplied from the hydraulic pump to slew the slewing body; a slewing speed sensor that detects a slewing speed of the slewing body; and a controller that controls a capacity of the slewing motor. In the controller, speed ranges with respect to the slewing speed are set, the speed ranges including a low speed range in which any slewing speed is less than or equal to a certain value and a high speed range in which any slewing speed is higher than that in the low speed range. The controller is configured to perform a large-capacity-in-low-speed-range control of controlling the slewing motor capacity so as to make the slewing motor capacity when the slewing speed detected by the slewing speed sensor is in the low-speed range be greater than the slewing motor capacity when the slewing speed is in the high speed range. The large-capacity-in-low-speed-range control is capable of both of increasing the slewing motor capacity relatively in the low velocity range to thereby improve the slewing acceleration performance while reducing the slewing motor capacity in the high velocity range relatively to thereby suppress an increase in the flow rate of hydraulic fluid supplied to the slewing motor.

The hydraulic system may further comprise a supply target hydraulic actuator that is a hydraulic actuator other than the slewing motor and configured to be operated by hydraulic fluid supplied from the hydraulic pump, the hydraulic fluid from the hydraulic pump being also supplied in parallel to the slewing motor. In this case, it is preferable that the controller is configured to perform the low-speed large-displacement control when the slewing motor and the supply target hydraulic actuator are simultaneously operated. This makes it possible to suppress reduction in the operation speed of the supply target hydraulic actuator when the slewing motor and the supply target hydraulic actuator are simultaneously operated.

The supply target hydraulic actuator is preferably, for example, a boom cylinder that moves up and down a boom of the construction machine, the boom being movable up and down relatively to the slewing body. This allows the improvement of the workability through the large-capacity-in-low-speed-range control to be more significant.

It is preferable that the hydraulic system further comprises a pump pressure sensor that detects a pump pressure, which is a discharge pressure of the hydraulic pump, and that the controller is configured to control the slewing motor capacity so as to reduce the slewing motor capacity with increase in the pump pressure. Such small-capacity-for-high-pressure control makes it possible to speed up the operation of the supply target hydraulic actuator while ensuring the acceleration performance of the slewing motor.

The invention claimed is:

1. A hydraulic system installed on a construction machine including a slewing body, comprising:

a hydraulic pump that discharges hydraulic fluid;

a slewing motor that is a variable displacement motor operated by hydraulic fluid supplied from the hydraulic pump to slew the slewing body;

a slewing speed sensor that detects a slewing speed of the slewing body;

a supply target hydraulic actuator that is a hydraulic actuator other than the slewing motor and configured to be operated by hydraulic fluid supplied from the hydraulic pump, the hydraulic fluid from the hydraulic pump being also supplied in parallel to the slewing motor;

a pump pressure sensor that detects a pump pressure, which is a discharge pressure of the hydraulic pump;

a controller that controls a capacity of the slewing motor, wherein:

in the controller, speed ranges with respect to the slewing speed are set, the speed ranges including a low speed range in which any slewing speed is less than or equal to a certain value and a high speed range in which any slewing speed is higher than that in the low speed range;

the controller is configured to perform a large-capacity-in-low-speed-range control of controlling the slewing motor capacity so as to make the slewing motor capacity when the slewing speed detected by the slewing speed sensor is in the low-speed range be greater than the slewing motor capacity when the slewing speed is in the high speed range;

the controller is configured to perform the large-capacity-in-low-speed-range control when the slewing motor and the supply target hydraulic actuator are simultaneously operated; and the controller is configured to control the slewing motor capacity so as to reduce the slewing motor capacity with increase in the pump pressure.

2. The hydraulic system according to claim 1, wherein the supply target hydraulic actuator is formed of a boom cylinder that moves up and down a boom of the construction machine, the boom being movable up and down relatively to the slewing body.

* * * * *